US008678035B2

(12) United States Patent
Fripp et al.

(10) Patent No.: US 8,678,035 B2
(45) Date of Patent: Mar. 25, 2014

(54) SELECTIVELY VARIABLE FLOW RESTRICTOR FOR USE IN A SUBTERRANEAN WELL

(75) Inventors: Michael L. Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 430 days.

(21) Appl. No.: 13/084,025

(22) Filed: Apr. 11, 2011

(65) Prior Publication Data

US 2012/0255739 A1 Oct. 11, 2012

(51) Int. Cl.
*F15C 1/16* (2006.01)

(52) U.S. Cl.
USPC ..... 137/810; 137/812; 137/829; 137/832

(58) Field of Classification Search
USPC ..... 137/809–815, 819–820, 829–832
See application file for complete search history.

(56) References Cited

U.S. PATENT DOCUMENTS

| | | | |
|---|---|---|---|
| 2,140,735 | A | 12/1938 | Clarke et al. |
| 2,324,819 | A | 6/1941 | Butzbach |
| 3,078,862 | A | 2/1963 | Maly |
| 3,091,393 | A | 5/1963 | Sparrow |
| 3,216,439 | A | 11/1965 | Manion |
| 3,233,621 | A | 2/1966 | Manion |
| 3,256,899 | A | 6/1966 | Dexter et al. |
| 3,282,279 | A | 11/1966 | Manion |
| 3,461,897 | A | 8/1969 | Kwok |
| 3,470,894 | A | 10/1969 | Rimmer |
| 3,474,670 | A | 10/1969 | Rupert |
| 3,489,009 | A | 1/1970 | Rimmer |
| 3,515,160 | A | 6/1970 | Cohen |
| 3,529,614 | A | 9/1970 | Nelson |
| 3,537,466 | A | 11/1970 | Chapin |
| 3,566,900 | A | 3/1971 | Black |
| 3,586,104 | A | 6/1971 | Hyde |

(Continued)

FOREIGN PATENT DOCUMENTS

| | | | |
|---|---|---|---|
| EP | 0834342 | A2 | 4/1998 |
| EP | 1857633 | A2 | 11/2007 |

(Continued)

OTHER PUBLICATIONS

Specification and Drawings for U.S. Appl. No. 13/430,507, filed Mar. 26, 2012, 28 pages.

(Continued)

*Primary Examiner* — Giovanna Wright
(74) *Attorney, Agent, or Firm* — Smith IP Services, P.C.

(57) ABSTRACT

A variable flow resistance system for use with a subterranean well can include a flow chamber through which a fluid composition flows, the chamber having at least two inlets, and a flow resistance which varies depending on proportions of the fluid composition which flow into the chamber via the respective inlet flow paths, and an actuator which varies the proportions. The actuator may deflect the fluid composition toward one of the inlet flow paths. A method of variably controlling flow resistance in a well can include changing an orientation of a deflector relative to a passage through which a fluid composition flows, thereby influencing the fluid composition to flow toward one of multiple inlet flow paths of a flow chamber, the chamber having a flow resistance which varies depending on proportions of the fluid composition which flow into the chamber via the respective inlet flow paths.

43 Claims, 8 Drawing Sheets

(56) References Cited

U.S. PATENT DOCUMENTS

| | | | | |
|---|---|---|---|---|
| 3,598,137 | A | | 8/1971 | Glaze |
| 3,620,238 | A | | 11/1971 | Kawabata et al. |
| 3,670,753 | A | | 6/1972 | Healey |
| 3,704,832 | A | | 12/1972 | Fix et al. |
| 3,712,321 | A | | 1/1973 | Bauer |
| 3,717,164 | A | | 2/1973 | Griffin |
| 3,754,576 | A | | 8/1973 | Zetterstrom et al. |
| 3,776,460 | A | * | 12/1973 | Fichter ..... 239/101 |
| 3,885,627 | A | | 5/1975 | Berry et al. |
| 3,942,557 | A | | 3/1976 | Tsuchiya |
| 4,029,127 | A | | 6/1977 | Thompson |
| 4,082,169 | A | | 4/1978 | Bowles |
| 4,127,173 | A | | 11/1978 | Watkins et al. |
| 4,167,873 | A | | 9/1979 | Bahrton |
| 4,187,909 | A | | 2/1980 | Erbstoesser |
| 4,276,943 | A | * | 7/1981 | Holmes ..... 175/40 |
| 4,286,627 | A | | 9/1981 | Graf |
| 4,291,395 | A | | 9/1981 | Holmes |
| 4,307,653 | A | | 12/1981 | Goes et al. |
| 4,323,991 | A | | 4/1982 | Holmes et al. |
| 4,385,875 | A | | 5/1983 | Kanazawa |
| 4,390,062 | A | | 6/1983 | Fox |
| 4,418,721 | A | | 12/1983 | Holmes |
| 4,557,295 | A | | 12/1985 | Holmes |
| 4,895,582 | A | | 1/1990 | Bielefeldt |
| 4,919,204 | A | | 4/1990 | Baker et al. |
| 5,165,450 | A | | 11/1992 | Marrelli |
| 5,184,678 | A | | 2/1993 | Pechkov et al. |
| 5,228,508 | A | | 7/1993 | Facteau et al. |
| 5,303,782 | A | | 4/1994 | Johannessen |
| 5,455,804 | A | | 10/1995 | Holmes et al. |
| 5,482,117 | A | | 1/1996 | Kolpak et al. |
| 5,484,016 | A | | 1/1996 | Surjaatmadja et al. |
| 5,505,262 | A | | 4/1996 | Cobb |
| 5,533,571 | A | | 7/1996 | Surjaatmadja et al. |
| 5,570,744 | A | | 11/1996 | Weingarten et al. |
| 5,893,383 | A | | 4/1999 | Facteau |
| 6,015,011 | A | | 1/2000 | Hunter |
| 6,078,471 | A | * | 6/2000 | Fiske ..... 360/254.2 |
| 6,109,372 | A | * | 8/2000 | Dorel et al. ..... 175/61 |
| 6,112,817 | A | | 9/2000 | Voll et al. |
| 6,241,019 | B1 | | 6/2001 | Davidson et al. |
| 6,336,502 | B1 | | 1/2002 | Surjaatmadja et al. |
| 6,345,963 | B1 | | 2/2002 | Thomin et al. |
| 6,367,547 | B1 | | 4/2002 | Towers et al. |
| 6,371,210 | B1 | | 4/2002 | Bode et al. |
| 6,405,797 | B2 | | 6/2002 | Davidson et al. |
| 6,497,252 | B1 | | 12/2002 | Kohler et al. |
| 6,619,394 | B2 | | 9/2003 | Soliman et al. |
| 6,622,794 | B2 | | 9/2003 | Zisk, Jr. |
| 6,627,081 | B1 | | 9/2003 | Hilditch et al. |
| 6,644,412 | B2 | | 11/2003 | Bode et al. |
| 6,691,781 | B2 | | 2/2004 | Grant et al. |
| 6,719,048 | B1 | | 4/2004 | Ramos et al. |
| 6,851,473 | B2 | | 2/2005 | Davidson |
| 6,913,079 | B2 | | 7/2005 | Tubel |
| 6,976,507 | B1 | | 12/2005 | Webb et al. |
| 7,025,134 | B2 | | 4/2006 | Byrd et al. |
| 7,114,560 | B2 | | 10/2006 | Nguyen et al. |
| 7,185,706 | B2 | | 3/2007 | Freyer |
| 7,213,650 | B2 | | 5/2007 | Lehman et al. |
| 7,213,681 | B2 | | 5/2007 | Birchak et al. |
| 7,216,738 | B2 | | 5/2007 | Birchak et al. |
| 7,290,606 | B2 | | 11/2007 | Coronado et al. |
| 7,318,471 | B2 | | 1/2008 | Rodney et al. |
| 7,404,416 | B2 | | 7/2008 | Schultz et al. |
| 7,405,998 | B2 | | 7/2008 | Webb et al. |
| 7,409,999 | B2 | | 8/2008 | Henriksen et al. |
| 7,413,010 | B2 | | 8/2008 | Blauch et al. |
| 7,537,056 | B2 | | 5/2009 | MacDougall |
| 7,578,343 | B2 | | 8/2009 | Augustine |
| 7,621,336 | B2 | | 11/2009 | Badalamenti et al. |
| 7,828,067 | B2 | | 11/2010 | Scott et al. |
| 7,857,050 | B2 | | 12/2010 | Zazovsky et al. |
| 8,127,856 | B1 | | 3/2012 | Nish et al. |
| 8,235,128 | B2 | | 8/2012 | Dykstra et al. |
| 8,302,696 | B2 | * | 11/2012 | Williams et al. ..... 166/381 |
| 8,327,885 | B2 | | 12/2012 | Dykstra et al. |
| 2005/0214147 | A1 | | 9/2005 | Schultz et al. |
| 2006/0131033 | A1 | | 6/2006 | Bode et al. |
| 2007/0028977 | A1 | | 2/2007 | Goulet |
| 2007/0045038 | A1 | | 3/2007 | Han et al. |
| 2007/0246407 | A1 | | 10/2007 | Richards et al. |
| 2007/0256828 | A1 | | 11/2007 | Birchak et al. |
| 2008/0035350 | A1 | | 2/2008 | Henriksen et al. |
| 2008/0041580 | A1 | | 2/2008 | Freyer et al. |
| 2008/0041581 | A1 | | 2/2008 | Richards |
| 2008/0041582 | A1 | | 2/2008 | Saetre et al. |
| 2008/0041588 | A1 | | 2/2008 | Richards et al. |
| 2008/0149323 | A1 | | 6/2008 | O'Malley et al. |
| 2008/0169099 | A1 | | 7/2008 | Pensgaard |
| 2008/0236839 | A1 | | 10/2008 | Oddie |
| 2008/0261295 | A1 | | 10/2008 | Butler et al. |
| 2008/0283238 | A1 | | 11/2008 | Richards et al. |
| 2008/0314590 | A1 | | 12/2008 | Patel |
| 2009/0000787 | A1 | | 1/2009 | Hill et al. |
| 2009/0008088 | A1 | | 1/2009 | Schultz et al. |
| 2009/0008090 | A1 | | 1/2009 | Schultz et al. |
| 2009/0009297 | A1 | | 1/2009 | Shinohara et al. |
| 2009/0009333 | A1 | | 1/2009 | Bhogal et al. |
| 2009/0009336 | A1 | | 1/2009 | Ishikawa |
| 2009/0009412 | A1 | | 1/2009 | Warther |
| 2009/0009437 | A1 | | 1/2009 | Hwang et al. |
| 2009/0009445 | A1 | | 1/2009 | Lee |
| 2009/0009447 | A1 | | 1/2009 | Naka et al. |
| 2009/0065197 | A1 | | 3/2009 | Eslinger |
| 2009/0078427 | A1 | | 3/2009 | Patel |
| 2009/0078428 | A1 | | 3/2009 | Ali |
| 2009/0101352 | A1 | | 4/2009 | Coronado et al. |
| 2009/0101354 | A1 | | 4/2009 | Holmes et al. |
| 2009/0120647 | A1 | | 5/2009 | Turick et al. |
| 2009/0133869 | A1 | | 5/2009 | Clem |
| 2009/0151925 | A1 | | 6/2009 | Richards et al. |
| 2009/0159282 | A1 | | 6/2009 | Webb et al. |
| 2009/0250224 | A1 | | 10/2009 | Wright et al. |
| 2009/0277639 | A1 | | 11/2009 | Schultz et al. |
| 2009/0277650 | A1 | | 11/2009 | Casciaro et al. |
| 2011/0042091 | A1 | | 2/2011 | Dykstra et al. |
| 2011/0042092 | A1 | | 2/2011 | Fripp et al. |
| 2011/0079384 | A1 | | 4/2011 | Russell et al. |
| 2011/0186300 | A1 | | 8/2011 | Dykstra et al. |
| 2011/0198097 | A1 | | 8/2011 | Moen |
| 2011/0214876 | A1 | | 9/2011 | Dykstra et al. |
| 2011/0297384 | A1 | | 12/2011 | Fripp et al. |
| 2011/0297385 | A1 | | 12/2011 | Dykstra et al. |
| 2012/0048563 | A1 | | 3/2012 | Holderman |
| 2012/0060624 | A1 | | 3/2012 | Dykstra |
| 2012/0061088 | A1 | | 3/2012 | Dykstra et al. |
| 2012/0125626 | A1 | | 5/2012 | Constantine |
| 2012/0168014 | A1 | | 7/2012 | Schultz et al. |
| 2012/0305243 | A1 | | 12/2012 | Hallundbaek et al. |
| 2013/0020088 | A1 | | 1/2013 | Dyer et al. |
| 2013/0042699 | A1 | | 2/2013 | Schultz et al. |
| 2013/0048274 | A1 | | 2/2013 | Schultz et al. |

FOREIGN PATENT DOCUMENTS

| | | | |
|---|---|---|---|
| EP | 2146049 | A2 | 1/2010 |
| WO | 0214647 | A1 | 2/2002 |
| WO | 03062597 | A1 | 7/2003 |
| WO | 2004033063 | A2 | 4/2004 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |

(56) References Cited

FOREIGN PATENT DOCUMENTS

| | | | |
|---|---|---|---|
| WO | 2010087719 | A1 | 8/2010 |
| WO | 2011095512 | A2 | 8/2011 |
| WO | 2011115494 | A1 | 9/2011 |

OTHER PUBLICATIONS

International Search Report with Written Opinion issued Mar. 26, 2012 for PCT Patent Application No. PCT/US11/048986, 9 pages.
International Search Report with Written Opinion issued Apr. 17, 2012 for PCT Patent Application No. PCT/US11/050255, 9 pages.
Office Action issued May 24, 2012 for U.S. Appl. No. 12/869,836, 60 pages.
Office Action issued May 24, 2012 for U.S. Appl. No. 13/430,507, 17 pages.
Specification and Drawings for U.S. Appl. No. 13/495,078, filed Jun. 13, 2012, 39 pages.
Office Action issued Jun. 19, 2012 for U.S. Appl. No. 13/111,169, 17 pages.
Office Action issued Oct. 26, 2011 for U.S. Appl. No. 13/111,169, 28 pages.
Advisory Action issued Aug. 30, 2012 for U.S. Appl. No. 13/111,169, 15 pages.
Office Action issued Sep. 10, 2012 for U.S. Appl. No. 12/792,095, 59 pages.
Office Action issued Dec. 28, 2012 for U.S. Appl. No. 12/881,296, 29 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31 2002, 8 pages.
Office Action issued Nov. 2, 2011 for U.S. Appl. No. 12/792,146, 34 pages.
Office Action issued Nov. 3, 2011 for U.S. Appl. No. 13/111,169, 16 pages.
Office Action issued Nov. 2, 2011 for U.S. Appl. No. 12/792117, 35 pages.
Office Action issued Oct. 27, 2011 for U.S. Appl. No. 12/791,993, 15 pages.
Office Action issued Mar. 4, 2013 for U.S. Appl. No. 13/678,497, 26 pages.
Office Action issued Mar. 4, 2013 for U.S. Appl. No. 13/659,375, 24 pages.
Advisory Action issued Mar. 14, 2013 for U.S. Appl. No. 13/495,078, 14 pages.
Office Action issued Mar. 15, 2013 for U.S. Appl. No. 13/659,435, 20 pages.
International Search Report with Written Opinion issued Jan. 5, 2012 for PCT Patent Application No. PCT/US2011/047925, 9 pages.
Stanley W. Angrist; "Fluid Control Devices", published Dec. 1964, 5 pages.
Office Action issued Feb. 21, 2013 for U.S. Appl. No. 12/792,095, 26 pages.
Lee Precision Micro Hydraulics, Lee Restrictor Selector product brochure; Jan. 2011, 9 pages.
Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.
Tesar, V.; Sampling by Fluidics and Microfluidics; Acta Polytechnica; Feb. 2002; pp. 41-49; vol. 42; The University of Sheffield; Sheffield, UK.
Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.
International Search Report and Written Opinion issued Mar. 25, 2011 for International Patent Application Serial No. PCT/US2010/044409, 9 pages.
International Search Report and Written Opinion issued Mar. 31, 2011 for International Patent Application Serial No. PCT/US2010/044421, 9 pages.
Office Action issued Jun. 27, 2011, for U.S. Appl. No. 12/791,993, 17 pages.
Office Action issued Apr. 23, 2013 for U.S. Appl. No. 13/659,323, 65 pages.
Office Action issued Apr. 24, 2013 for U.S. Appl. No. 13/633,693, 33 pages.
Office Action issued Apr. 26, 2013 for U.S. Appl. No. 13/678,489, 51 pages.
Office Action issued May 8, 2013 for U.S. Appl. No. 12/792,095, 14 pages.
Office Action issued May 29, 2013 for U.S. Appl. No. 12/881,296, 26 pages.
Specification and Drawings for U.S. Appl. No. 12/542,695, filed Aug. 18, 2009, 32 pages.
International Search Report with Written Opinion issued Aug. 3, 2012 for PCT Patent Application No. PCT/US11/059530, 15 pages.
International Search Report with Written Opinion issued Aug. 3, 2012 for PCT Patent Application No. PCT/US11/059534, 14 pages.
Office Action issued Jul. 25, 2012 for U.S. Appl. No. 12/881,296, 61 pages.
International Search Report with Written Opinion dated Aug. 31, 2012 for PCT Patent Application No. PCT/US11/060606, 10 pages.
Office Action issued Sep. 19, 2012 for U.S. Appl. No. 12/879,846, 78 pages.
Office Action issued Sep. 19, 2012 for U.S. Appl. No. 113/495,078, 29 pages.
Search Report and Written Opinion issued Oct. 19, 2012 for International Application No. PCT/US12/30641, 9 pages.
Specification and Drawings for U.S. Appl. No. 13/659,323, filed Oct. 24, 2012, 81 pages.
Specification and Drawings for U.S. Appl. No. 13/659,375, filed Oct. 24, 2012, 54 pages.
Specification and Drawings for U.S. Appl. No. 13/659,435, filed Oct. 24, 2012, 37 pages.
Office Action issued Jan. 17, 2013 for U.S. Appl. No. 12/879,846, 26 pages.
Office Action issued Jan. 16, 2013 for U.S. Appl. No. 13/495,078, 24 pages.
Office Action issued Jan. 22, 2013 for U.S. Appl. No. 13/633,693, 30 pages.
U.S. Appl. No. 13/351,035, filed Jan. 16, 2012, 62 pages.
U.S. Appl. No. 13/359,617, filed Jan. 27, 2012, 42 pages.
U.S. Appl. No. 12/958,625, filed Dec. 2, 2010, 37 pages.
U.S. Appl. No. 12/974,212, filed Dec. 21, 2010, 41 pages.
Office Action issued Mar. 7, 2012 for U.S. Appl. No. 12/792,117, 40 pages.
Office Action issued Mar. 8, 2012 for U.S. Appl. No. 12/792,146, 26 pages.
Office Action issued Oct. 11, 2013 for U.S. Appl. No. 12/792,095, 18 pages.
Joseph M. Kirchner, "Fluid Amplifiers", 1996, 6 pages, McGraw-Hill, New York.
Joseph M. Kirchner, et al., "Design Theory of Fluidic Components", 1975, 9 pages, Academic Press, New York.
Microsoft Corporation, "Fluidics" article, Microsoft Encarta Online Encyclopedia, copyright 1997-2009, 1 page, USA.
The Lee Company Technical Center, "Technical Hydraulic Handbook" 11th Edition, copyright 1971-2009, 7 pages, Connecticut.
Specification and Drawings for U.S. Appl. No. 12/792,095, filed Jun. 2, 2010, 29 pages.
Specification and Drawings for U.S. Appl. No. 10/650,186, filed Aug. 28, 2003, 16 pages.
Apparatus and Method of Inducing Fluidic Oscillation in a Rotating Cleaning Nozzle, ip.com, dated Apr. 24, 2007, 3 pages.

(56) References Cited

OTHER PUBLICATIONS

Office Action issued Aug. 20, 2013 for U.S. Appl. No. 13/659,375, 24 pages.
Office Action issued Aug. 7, 2013 for U.S. Appl. No. 13/659,323, 37 pages.
Office Action issued Aug. 7, 2013 for U.S. Appl. No. 13/678,489, 24 pages.
Office Action issued Dec. 24, 2013 for U.S. Appl. No. 12/881,296, 30 pages.
Advisory Action issued Dec. 27, 2013 for U.S. Appl. No. 12/792,095, 8 pages.

* cited by examiner

SELECTIVELY VARIABLE FLOW RESTRICTOR FOR USE IN A SUBTERRANEAN WELL

BACKGROUND

This disclosure relates generally to equipment utilized and operations performed in conjunction with a subterranean well and, in an example described below, more particularly provides a selectively variable flow restrictor.

In a hydrocarbon production well, it is many times beneficial to be able to regulate flow of fluids from an earth formation into a wellbore, from the wellbore into the formation, and within the wellbore. A variety of purposes may be served by such regulation, including prevention of water or gas coning, minimizing sand production, minimizing water and/or gas production, maximizing oil production, balancing production among zones, transmitting signals, etc.

Therefore, it will be appreciated that advancements in the art of variably restricting fluid flow in a well would be desirable in the circumstances mentioned above, and such advancements would also be beneficial in a wide variety of other circumstances.

SUMMARY

In the disclosure below, a variable flow resistance system is provided which brings improvements to the art of variably restricting fluid flow in a well. Examples are described below in which the flow is selectively restricted for various purposes.

In one aspect, a variable flow resistance system for use with a subterranean well is provided to the art. The system can include a flow chamber through which a fluid composition flows, the chamber having at least two inlet flow paths, and a flow resistance which varies depending on proportions of the fluid composition which flow into the chamber via the respective inlet flow paths. An actuator deflects the fluid composition toward one of the inlet flow paths.

In another aspect, a method of variably controlling flow resistance in a well is described below. The method can include changing an orientation of a deflector relative to a passage through which a fluid composition flows, thereby influencing the fluid composition to flow toward one of multiple inlet flow paths of a flow chamber, the chamber having a flow resistance which varies depending on proportions of the fluid composition which flow into the chamber via the respective inlet flow paths.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
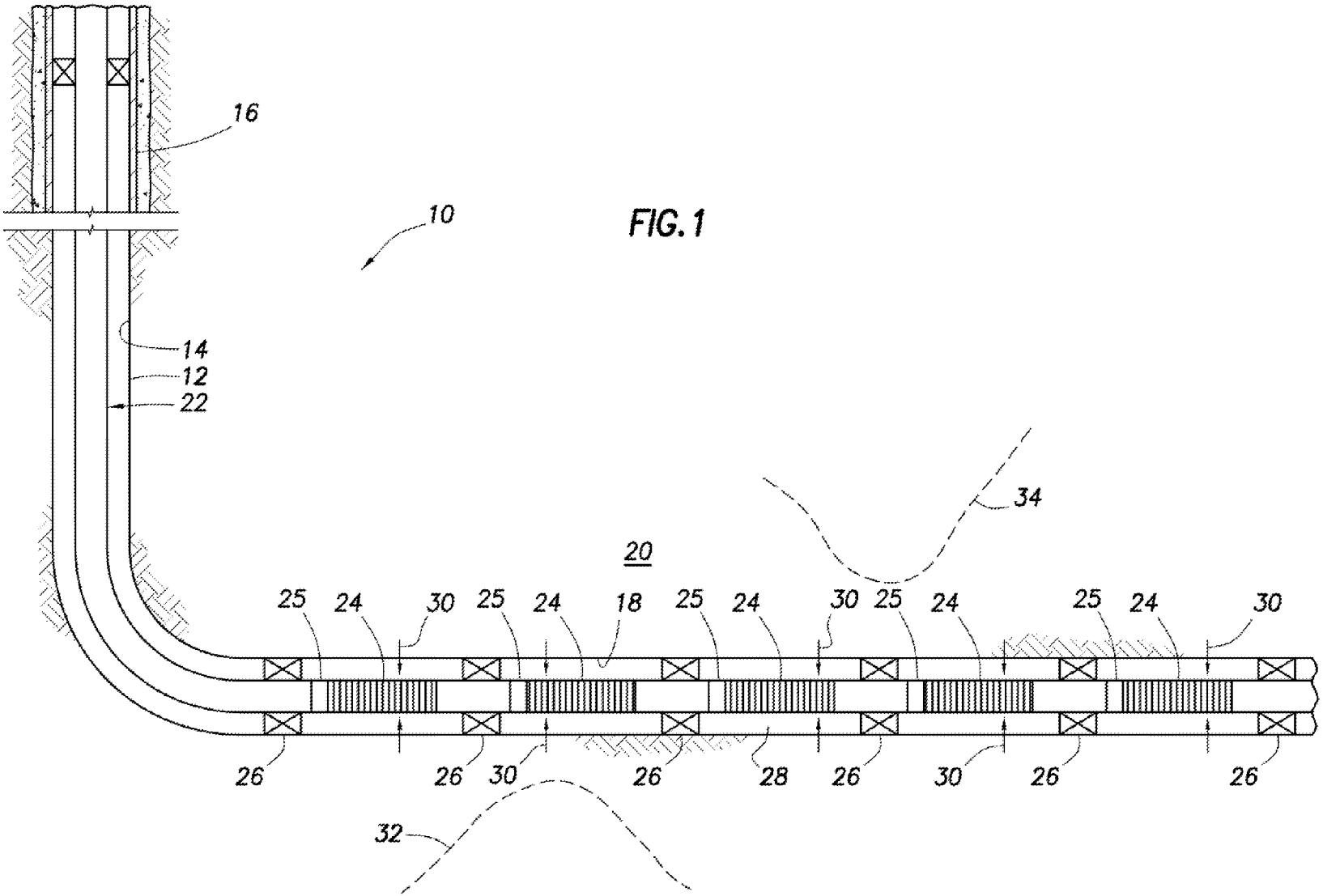
FIG. 1 is a representative partially cross-sectional view of a well system which can embody principles of this disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids and/or based on operation of an actuator thereof (as described more fully below).

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, transmitting signals, etc.

In examples described below, resistance to flow through the systems 25 can be selectively varied, on demand and/or in response to a particular condition. For example, flow through the systems 25 could be relatively restricted while the tubular string 22 is installed, and during a gravel packing operation, but flow through the systems could be relatively unrestricted when producing the fluid 30 from the formation 20. As another example, flow through the systems 25 could be relatively restricted at elevated temperature indicative of steam breakthrough in a steam flooding operation, but flow through the systems could be relatively unrestricted at reduced temperatures.

An example of the variable flow resistance systems 25 described more fully below can also increase resistance to flow if a fluid velocity or density increases (e.g., to thereby balance flow among zones, prevent water or gas coning, etc.), or increase resistance to flow if a fluid viscosity decreases (e.g., to thereby restrict flow of an undesired fluid, such as water or gas, in an oil producing well). Conversely, these variable flow resistance systems 25 can decrease resistance to flow if fluid velocity or density decreases, or if fluid viscosity increases.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
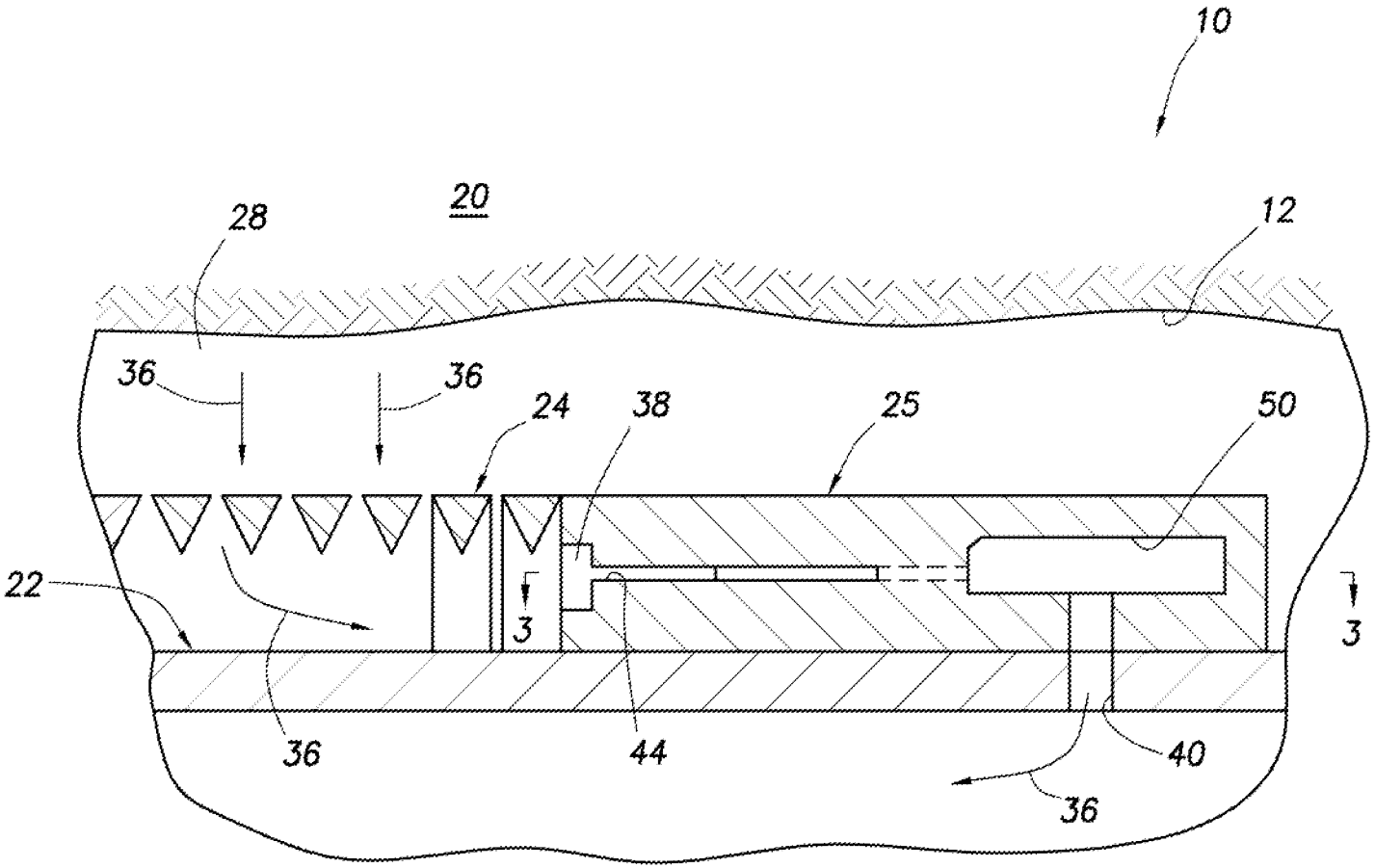
FIG. 2 is a representative enlarged scale cross-sectional view of a portion of the well system.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as viscosity, velocity, density, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
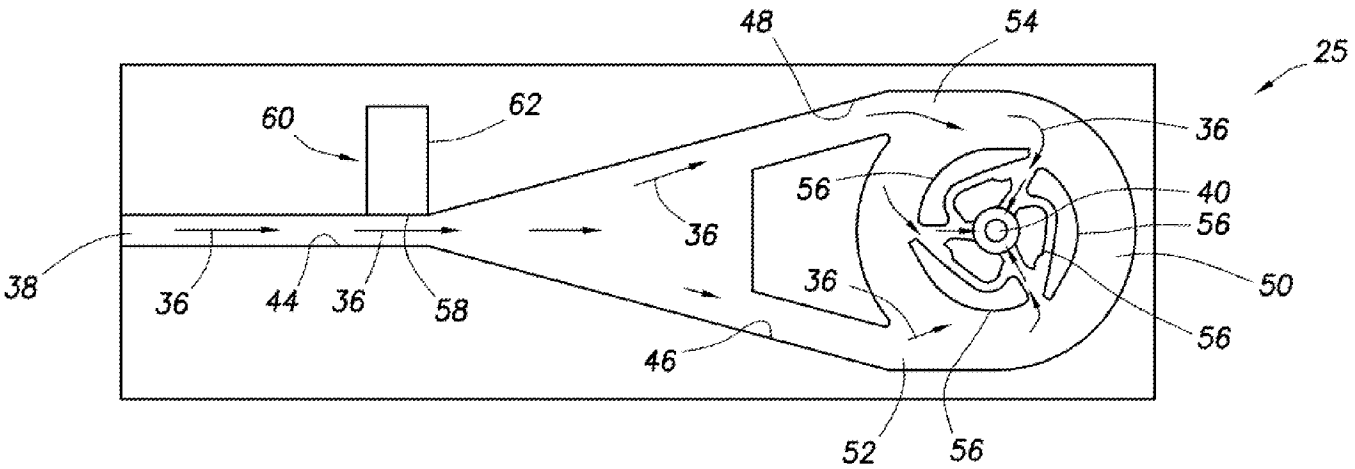
FIG. 3 is a representative cross-sectional view of a variable flow resistance system which can be used in the well system, the variable flow resistance system embodying principles of this disclosure, with flow through the system being relatively unrestricted.

Referring additionally now to FIG. 3, a cross-sectional view of the variable flow resistance system 25, taken along line 3-3 of FIG. 2, is representatively illustrated. The variable flow resistance system 25 example depicted in FIG. 3 may be used in the well system 10 of FIGS. 1 & 2, or it may be used in other well systems in keeping with the principles of this disclosure.

In FIG. 3, it may be seen that the fluid composition 36 flows from the inlet 38 to the outlet 40 via passage 44, inlet flow paths 46, 48 and a flow chamber 50. The flow paths 46, 48 are branches of the passage 44 and intersect the chamber 50 at inlets 52, 54.

Although in FIG. 3 the flow paths 46, 48 diverge from the inlet passage 44 by approximately the same angle, in other examples the flow paths 46, 48 may not be symmetrical with respect to the passage 44. For example, the flow path 48 could diverge from the inlet passage 44 by a smaller angle as compared to the flow path 46, so that, when an actuator member 62 is not extended (as depicted in FIG. 3), more of the fluid composition 36 will flow through the flow path 48 to the chamber 50.

As depicted in FIG. 3, more of the fluid composition 36 does enter the chamber 50 via the flow path 48, due to the well-known Coanda or "wall" effect. However, in other examples, the fluid composition 36 could enter the chamber 50 substantially equally via the flow paths 46, 48.

A resistance to flow of the fluid composition 36 through the system 25 depends on proportions of the fluid composition which flow into the chamber via the respective flow paths 46, 48 and inlets 52, 54. As depicted in FIG. 3, approximately half of the fluid composition 36 flows into the chamber 50 via the flow path 46 and inlet 52, and about half of the fluid composition flows into the chamber via the flow path 48 and inlet 54.

In this situation, flow through the system 25 is relatively unrestricted. The fluid composition 36 can readily flow between various structures 56 in the chamber 50 en route to the outlet 40.

Figure 4:
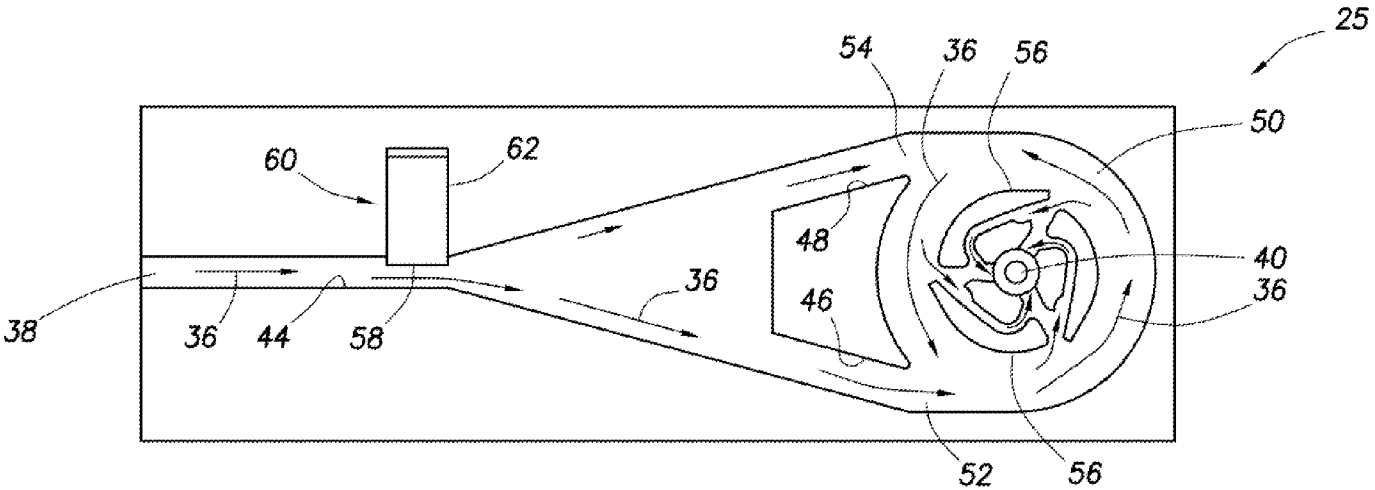
FIG. 4 is a representative cross-sectional view of the variable flow resistance system, with flow through the system being relatively restricted.

Referring additionally now to FIG. 4, the system 25 is representatively illustrated in another configuration, in which flow resistance through the system is increased, as compared to the configuration of FIG. 3. Preferably, this increase in flow resistance of the system 25 is not due to a change in a property of the fluid composition 36 (although in other examples the flow resistance increase could be due to a change in a property of the fluid composition).

As depicted in FIG. 4, a deflector 58 has been displaced relative to the passage 44, so that the fluid composition 36 is influenced to flow more toward the branch flow path 46. A greater proportion of the fluid composition 36, thus, flows through the flow path 46 and into the chamber 50 via the inlet 52, as compared to the proportion which flows into the chamber via the inlet 54.

When a majority of the fluid composition 36 flows into the chamber 50 via the inlet 52, the fluid composition tends to rotate counter-clockwise in the chamber (as viewed in FIG. 4). The structures 56 are designed to promote such rotational flow in the chamber 50, and as a result, more energy in the fluid composition 36 flow is dissipated. Thus, resistance to flow through the system 25 is increased in the FIG. 4 configuration as compared to the FIG. 3 configuration.

In this example, the deflector 58 is displaced by an actuator 60. Any type of actuator may be used for the actuator 60. The actuator 60 may be operated in response to any type of stimulus (e.g., electrical, magnetic, temperature, etc.).

In other examples, the deflector 58 could move in response to erosion or corrosion of the deflector (i.e., so that its surface is moved). In another example, the deflector 58 could be a sacrificial anode in a galvanic cell. In another example, the deflector 58 could move by being dissolved (e.g., with the deflector being made of salt, polylactic acid, etc.). In yet another example, the deflector 58 could move by deposition on its surface (such as, from scale, asphaltenes, paraffins, etc., or from galvanic deposition as a protected cathode).

Although it appears in FIG. 4 that a member 62 of the actuator 60 has moved to thereby displace the deflector 58, in other examples the deflector can be displaced without moving an actuator member from one position to another. The member 62 could instead change configuration (e.g., elongating, retracting, expanding, swelling, etc.), without necessarily moving from one position to another.

Although in FIGS. 3 & 4 the flow chamber 50 has multiple inlets 52, 54, any number (including one) of inlets may be used in keeping with the scope of this disclosure. For example, in U.S. application Ser. No. 12/792,117, filed on 2 Jun. 2010, a flow chamber is described which has only a single inlet, but resistance to flow through the chamber varies depending on via which flow path a majority of a fluid composition enters the chamber.

Figure 5:
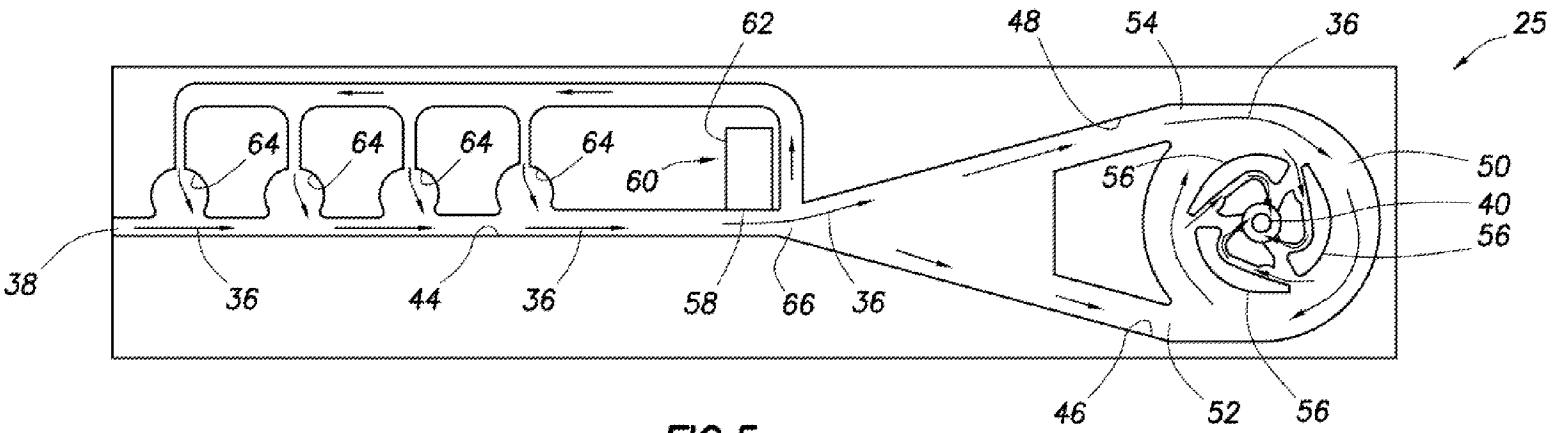
FIG. 5 is a representative cross-sectional view of another configuration of the variable flow resistance system, with flow through the system being relatively restricted.
Figure 6:
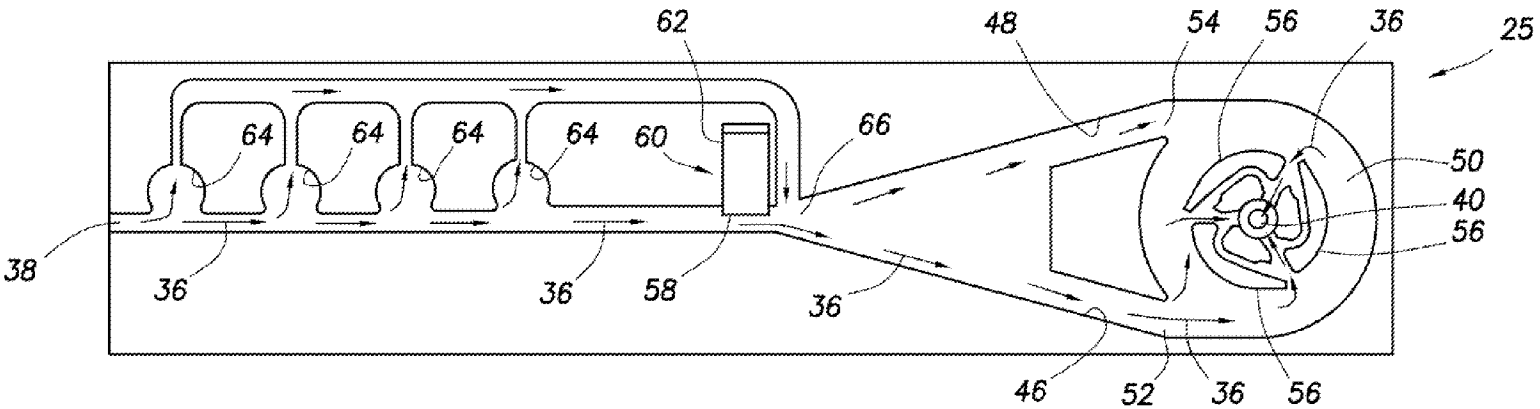
FIG. 6 is a representative cross-sectional view of the FIG. 5 configuration of the variable flow resistance system, with flow through the system being relatively unrestricted.

Another configuration of the variable flow resistance system is representatively illustrated in FIGS. 5 & 6. In this configuration, flow resistance through the system 25 can be varied due to a change in a property of the fluid composition 36, or in response to a particular condition or stimulus using the actuator 60.

In FIG. 5, the fluid composition 36 has a relatively high velocity. As the fluid composition 36 flows through the passage 44, it passes multiple chambers 64 formed in a side of the passage. Each of the chambers 64 is in communication with a pressure-operated fluid switch 66.

At elevated velocities of the fluid composition 36 in the passage 44, a reduced pressure will be applied to the fluid switch 66 as a result of the fluid composition flowing past the chambers 64, and the fluid composition will be influenced to flow toward the branch flow path 48, as depicted in FIG. 5. A majority of the fluid composition 36 flows into the chamber 50 via the inlet 54, and flow resistance through the system 25 is increased. At lower velocities and increased viscosities, more of the fluid composition 36 will flow into the chamber 50 via the inlet 52, and flow resistance through the system 25 is decreased due to less rotational flow in the chamber.

In FIG. 6, the actuator 60 has been operated to deflect the fluid composition 36 from the passage 44 toward the branch flow path 46. Rotational flow of the fluid composition 36 in the chamber 50 is reduced, and the resistance to flow through the system 25 is, thus, also reduced.

Note that, if the velocity of the fluid composition 36 in the passage 44 is reduced, or if the viscosity of the fluid composition is increased, a portion of the fluid composition can flow into the chambers 64 and to the fluid switch 66, which also influences the fluid composition to flow more toward the flow path 46. However, preferably the movement of the deflector 58 is effective to direct the fluid composition 36 to flow toward the flow path 46, whether or not the fluid composition flows to the fluid switch 66 from the chambers 64.

Referring additionally now to FIGS. 7-11, examples of various configurations of the actuator 60 are representatively illustrated. The actuators 60 of FIGS. 7-11 may be used in the variable flow resistance system 25, or they may be used in other systems in keeping with the principles of this disclosure.

Figure 7:
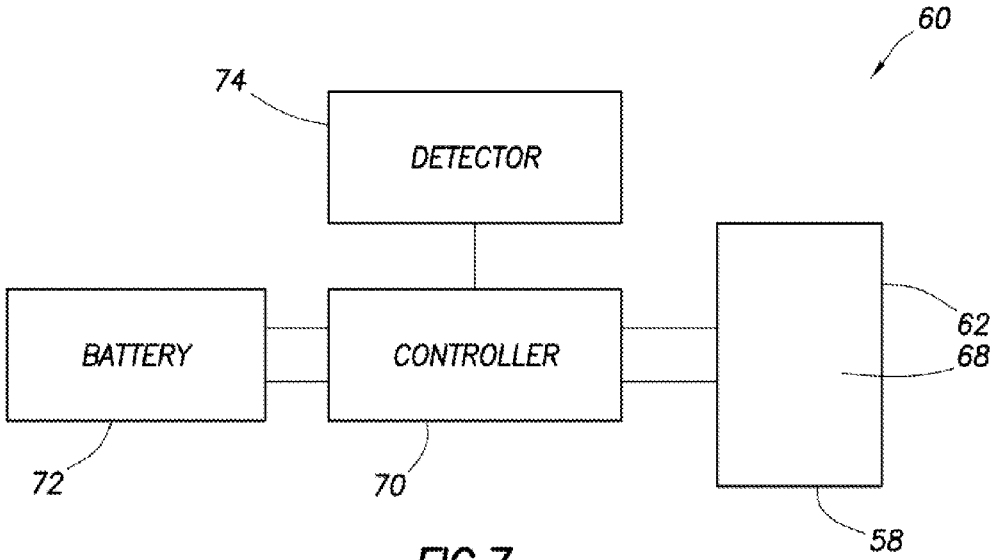
FIGS. 7-11 are representative diagrams of actuator configurations which may be used in the variable flow resistance system.

In FIG. 7, the actuator 60 comprises the member 62 having the deflector 58 formed thereon, or attached thereto. The member 62 comprises a material 68 which changes shape or moves in response to an electrical signal or stimulus from a controller 70. Electrical power may be supplied to the controller 70 by a battery 72 or another source (such as an electrical generator, etc.).

A sensor or detector 74 may be used to detect a signal transmitted to the actuator 60 from a remote location (such as the earth's surface, a subsea wellhead, a rig, a production facility, etc.). The signal could be a telemetry signal transmitted by, for example, acoustic waves, pressure pulses, electromagnetic waves, vibrations, pipe manipulations, etc. Any type of signal may be detected by the detector 74 in keeping with the principles of this disclosure.

The material 68 may be any type of material which can change shape or move in response to application or withdrawal of an electrical stimulus. Examples include piezoceramics, piezoelectrics, electrostrictors, etc. A pyroelectric material could be included, in order to generate electricity in response to a particular change in temperature.

The electrical stimulus may be applied to deflect the fluid composition 36 toward the branch flow path 46, or to deflect the fluid composition toward the branch flow path 48. Alternatively, the electrical stimulus may be applied when no deflection of the fluid composition 36 by the deflector 58 is desired.

Figure 8:
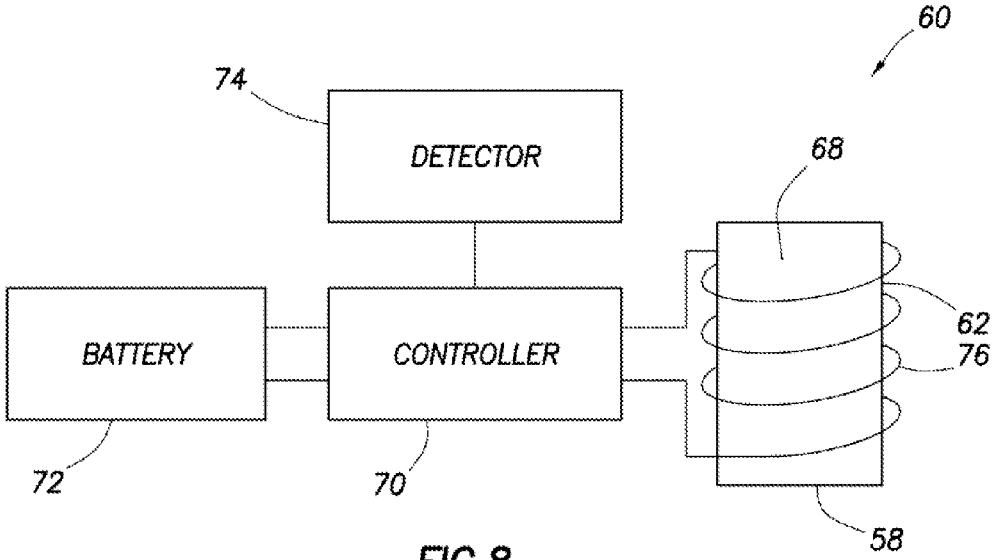

In FIG. 8, the member 62 comprises the material 68 which, in this configuration, changes shape or moves in response to a magnetic signal or stimulus from the controller 70. In this example, electrical current supplied by the controller 70 is converted into a magnetic field using a coil 76, but other techniques for applying a magnetic field to the material 68 (e.g., permanent magnets, etc.) may be used, if desired.

The material 68 in this example may be any type of material which can change shape or move in response to application or withdrawal of a magnetic field. Examples include magnetic shape memory materials, magnetostrictors, permanent magnets, ferromagnetic materials, etc.

In one example, the member 62 and coil 76 could comprise a voice coil or a solenoid. The solenoid could be a latching solenoid. In any of the examples described herein, the actuator 60 could be bi-stable and could lock into the extended and/or retracted configurations.

The magnetic field may be applied to deflect the fluid composition 36 toward the branch flow path 46, or to deflect the fluid composition toward the branch flow path 48. Alternatively, the magnetic field may be applied when no deflection of the fluid composition 36 by the deflector 58 is desired.

Figure 9:
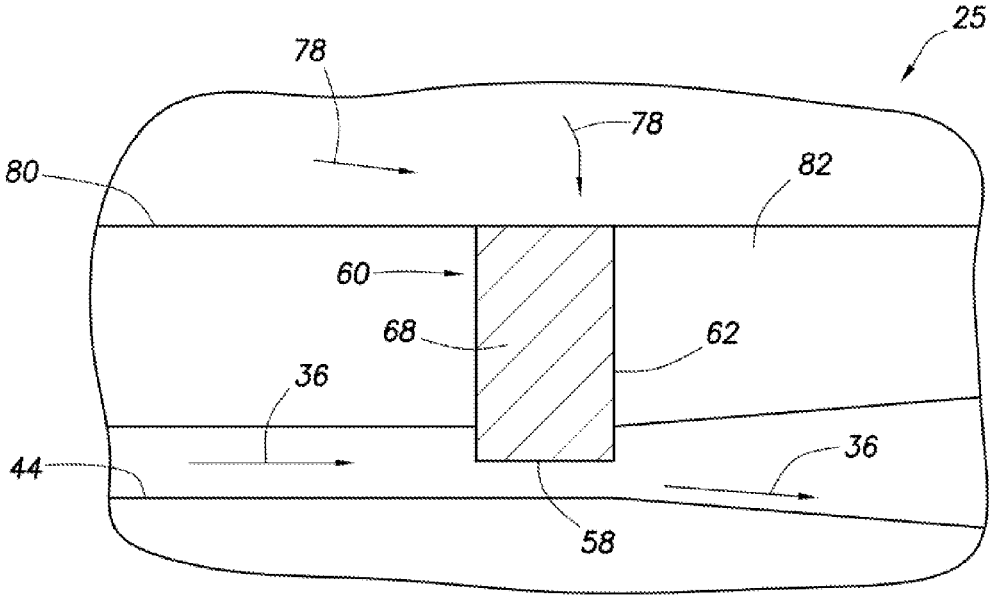

In FIG. 9, the deflector 58 deflects the fluid composition 36 which flows through the passage 44. In one example, the deflector 58 can displace relative to the passage 44 due to erosion or corrosion of the member 62. This erosion or corrosion could be due to human intervention (e.g., by contacting the member 62 with a corrosive fluid), or it could be due to passage of time (e.g., due to flow of the fluid composition 36 over the member 62).

In another example, the member 62 can be made to relatively quickly corrode by making it a sacrificial anode in a galvanic cell. An electrolyte fluid 78 could be selectively introduced into a passage 80 (such as, via a line extending to a remote location, etc.) exposed to the material 68, which could be less noble as compared to another material 82 also exposed to the fluid.

The member 62 could grow due to galvanic deposition on its surface if, for example, the member is a protected cathode in the galvanic cell. The member 62 could, in other examples, grow due to deposition of scale, asphaltenes, paraffins, etc. on the member.

In yet another example, the material 68 could be swellable, and the fluid 78 could be a type of fluid which causes the material to swell (i.e., increase in volume). Various materials are known (e.g., see U.S. Pat. Nos. 3,385,367 and 7,059,415, and U.S. Publication Nos. 2004-0020662 and 2007-0257405) which swell in response to contact with water, liquid hydrocarbons and/or gaseous or supercritical hydrocarbons. Alternatively, the material 68 could swell in response to the fluid composition 36 comprising an increased ratio of desired fluid to undesired fluid, or an increased ratio of undesired fluid to desired fluid.

In a further example, the material 68 could swell in response to a change in ion concentration (such as a pH of the fluid 78, or of the fluid composition 36). For example, the material 68 could comprise a polymer hydrogel.

In yet another example, the material 68 could swell or change shape in response to an increase in temperature. For example, the material 68 could comprise a temperature-sensitive wax or a thermal shape memory material, etc.

Figure 10:
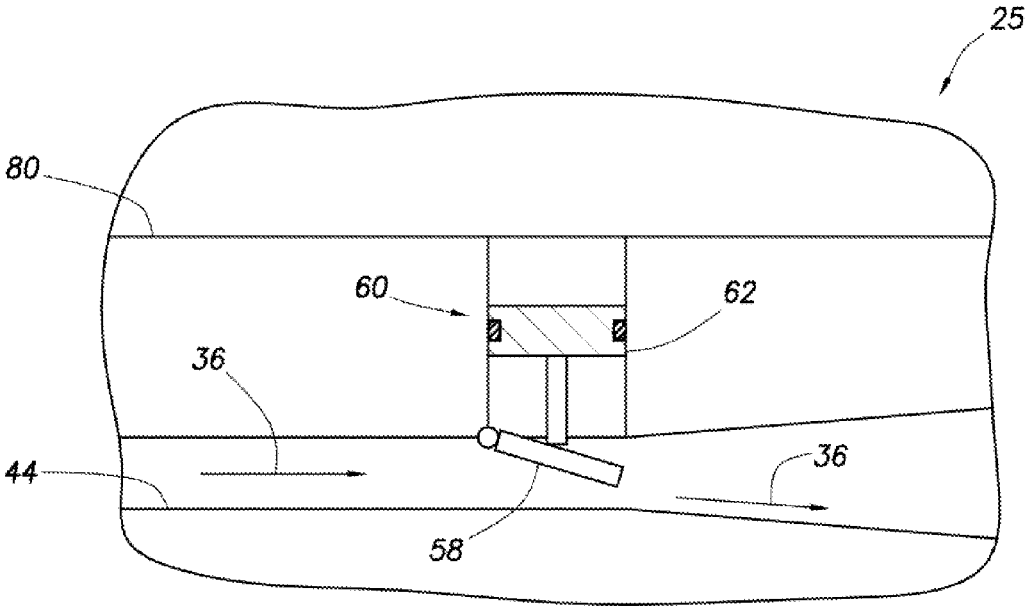

In FIG. 10, the member 62 comprises a piston which displaces in response to a pressure differential between the passage 80 and the passage 44. When it is desired to move the deflector 58, pressure in the passage 80 is increased or decreased (e.g., via a line extending to a pressure source at a remote location, etc.) relative to pressure in the passage 44.

The deflector 58 is depicted in FIG. 10 as being in the form of a hinged vane, but it should be clearly understood that any form of deflector may be used in keeping with this disclosure. For example, the deflector 58 could be in the form of an airfoil, etc.

In the FIG. 10 configuration, the position of the deflector 58 can be dependent on a property (pressure) of the fluid composition 36.

Figure 11:
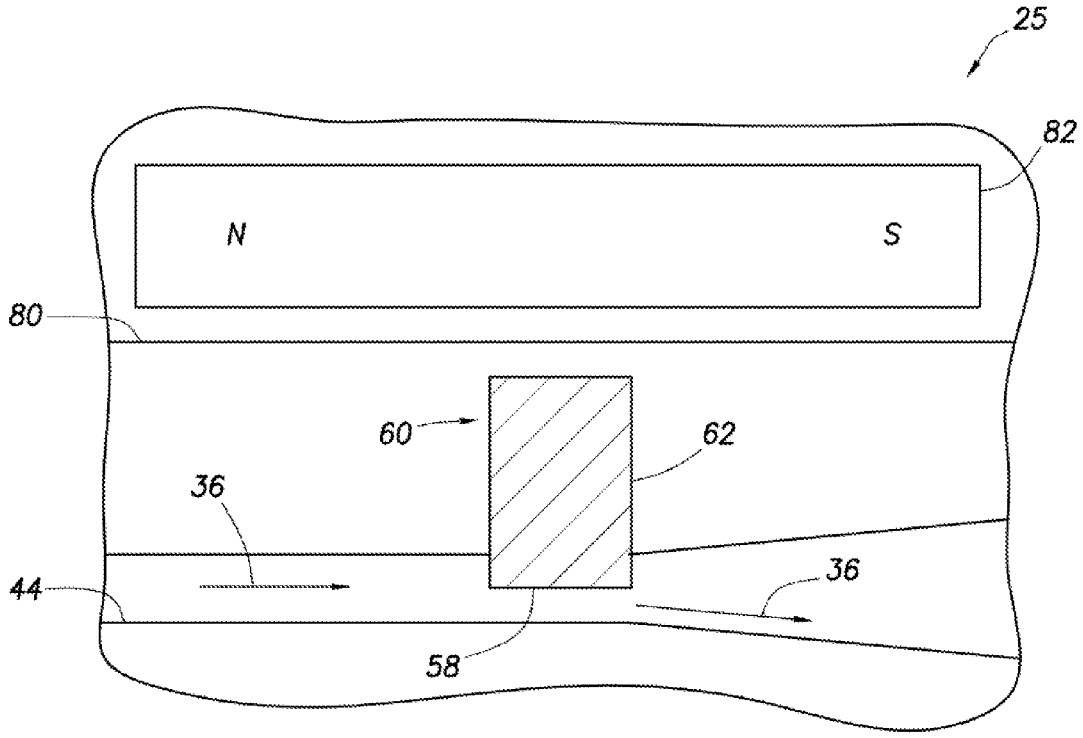

In FIG. 11, the actuator 60 is operated in response to application or withdrawal of a magnetic field. For example, the magnetic field could be applied by conveying a magnetic device 82 into the passage 80, which could extend through the tubular string 22 to a remote location.

The actuator 60 in this configuration could include any of the material 68 discussed above in relation to the FIG. 8 configuration (e.g., materials which can change shape or move in response to application or withdrawal of a magnetic field, magnetic shape memory materials, magnetostrictors, permanent magnets, ferromagnetic materials, etc.).

The magnetic device 82 could be any type of device which produces a magnetic field. Examples include permanent magnets, electromagnets, etc. The device 82 could be conveyed by wireline, slickline, etc., the device could be dropped or pumped through the passage 80, etc.

One useful application of the FIG. 11 configuration is to enable individual or multiple actuators 60 to be selectively operated. For example, in the well system 10 of FIG. 1, it may be desired to increase or decrease resistance to flow through some or all of the variable flow resistance systems 25. A magnetic dart could be dropped or pumped through all of the systems 25 to operate all of the actuators 60, or a wireline-conveyed electromagnet could be selectively positioned adjacent some of the systems to operate those selected actuators.

Figure 12:
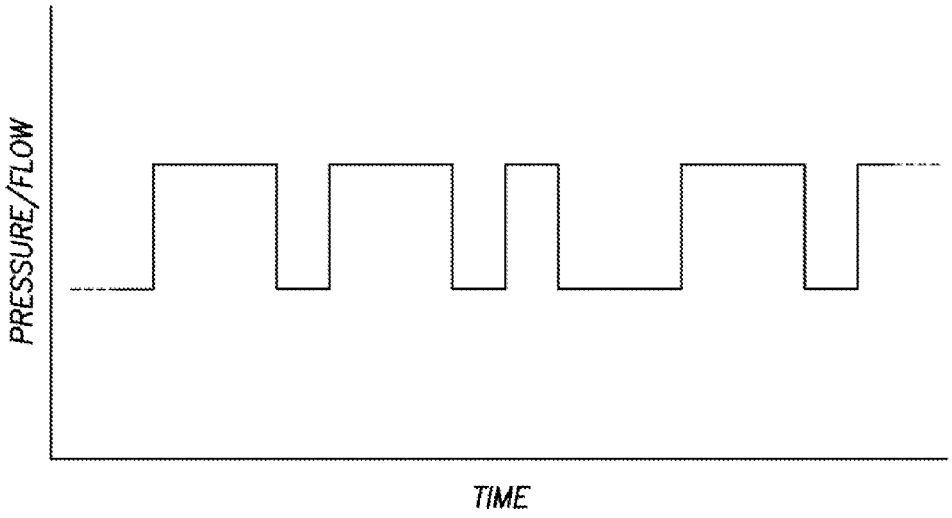
FIG. 12 is a representative graph of pressure or flow versus time in a method which can embody principles of this disclosure.

Referring additionally now to FIG. 12, an example graph of pressure or flow rate of the fluid composition 36 versus time is representatively illustrated. Note that the pressure and/or flow rate can be selectively varied by operating the actuator 60 of the variable flow resistance system 25, and this variation in pressure and/or flow rate can be used to transmit a signal to a remote location.

Figure 13:
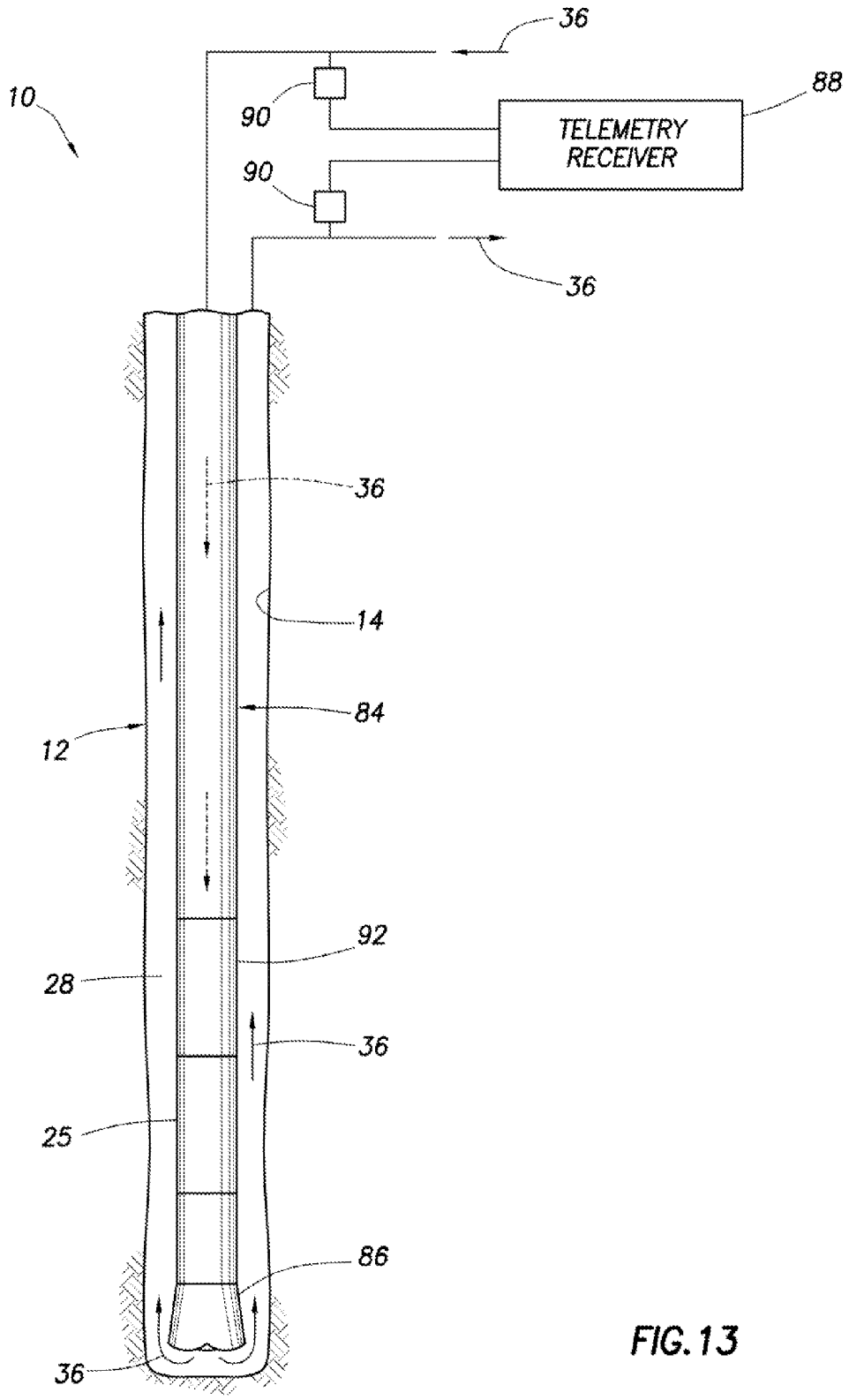
FIG. 13 is a representative partially cross-sectional view of the method being used for transmitting signals from the variable flow resistance system to a remote location.

In FIG. 13, the well system 10 is representatively illustrated while the uncased section 14 of the wellbore 12 is being drilled. The fluid composition 36 (known as drilling mud in this situation) is circulated through a tubular string 84 (a drill string in this situation), exits a drill bit 86, and returns to the surface via the annulus 28.

The actuator 60 can be operated using the controller 70 as described above, so that pressure and/or flow rate variations are produced in the fluid composition 36. These pressure and/or flow rate variations can have data, commands or other information modulated thereon. In this manner, signals can be transmitted to the remote location by the variable flow resistance system 25.

As depicted in FIG. 13, a telemetry receiver 88 at a remote location detects the pressure and/or flow rate variations using one or more sensors 90 which measure these properties upstream and/or downstream of the system 25. In one example, the system 25 could transmit to the remote location pressure and/or flow rate signals indicative of measurements taken by measurement while drilling (MWD), logging while drilling (LWD), pressure while drilling (PWD), or other sensors 92 interconnected in the tubular string 84.

In other examples, the signal-transmitting capabilities of the system 25 could be used in production, injection, stimulation, completion or other types of operations. In a production operation, (e.g., the FIG. 1 example), the systems 25 could transmit to a remote location signals indicative of flow rate, pressure, composition, temperature, etc. for each individual zone being produced.

It may now be fully appreciated that the above disclosure provides significant advancements to the art of variably restricting flow of fluid in a well. Some or all of the variable flow resistance system 25 examples described above can be operated remotely to reliably regulate flow between a formation 20 and an interior of a tubular string 22. Some or all of the system 25 examples described above can be operated to transmit signals to a remote location, and/or can receive remotely-transmitted signals to operate the actuator 60.

In one aspect, the above disclosure describes a variable flow resistance system 25 for use with a subterranean well. The system 25 can include a flow chamber 50 through which a fluid composition 36 flows, the chamber 50 having multiple inlet flow paths 46, 48, and a flow resistance which varies depending on proportions of the fluid composition 36 which flow into the chamber 50 via the respective inlet flow paths 46, 48. An actuator 60 can vary the proportions of the fluid composition 36 which flow into the chamber 50 via the respective inlet flow paths 46, 48.

The actuator 60 may deflect the fluid composition 36 toward an inlet flow path 46. The actuator 60 may displace a deflector 58 relative to a passage 44 through which the fluid composition 36 flows.

The actuator 60 may comprise a swellable material, a material which changes shape in response to contact with a selected fluid type, and/or a material which changes shape in response to a temperature change.

The actuator 60 can comprise a piezoceramic material, and/or a material selected from the following group: piezoelectric, pyroelectric, electrostrictor, magnetostrictor, magnetic shape memory, permanent magnet, ferromagnetic, swellable, polymer hydrogel, and thermal shape memory. The actuator 60 can comprise an electromagnetic actuator.

The system 25 may include a controller 70 which controls operation of the actuator 60. The controller 70 may respond to a signal transmitted from a remote location. The signal may comprise an electrical signal, a magnetic signal, and/or a signal selected from the following group: thermal, ion concentration, and fluid type.

The fluid composition 36 may flows through the flow chamber 50 in the well.

The system 25 may also include a fluid switch 66 which, in response to a change in a property of the fluid composition 36, varies the proportions of the fluid composition 36 which flow into the chamber 50 via the respective inlet flow paths 46, 48. The property may comprise at least one of the following group: velocity, viscosity, density, and ratio of desired fluid to undesired fluid.

Deflection of the fluid composition 36 by the actuator 60 may transmit a signal to a remote location. The signal may comprise pressure and/or flow rate variations.

Also provided by the above disclosure is a method of variably controlling flow resistance in a well. The method can include changing an orientation of a deflector 58 relative to a passage 44 through which a fluid composition 36 flows, thereby influencing the fluid composition 36 to flow toward one of multiple inlet flow paths 46, 48 of a flow chamber 50, the chamber 50 having a flow resistance which varies depending on proportions of the fluid composition 36 which flow into the chamber 50 via the respective inlet flow paths 46, 48.

Changing the orientation of the deflector 58 can include transmitting a signal to a remote location. Transmitting the signal can include a controller 70 selectively operating an actuator 60 which displaces the deflector 58 relative to the passage 44.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A variable flow resistance system for use with a subterranean well, the system comprising:

a flow chamber through which a fluid composition flows, the chamber having multiple inlet flow paths, and a flow resistance which varies depending on proportions of the fluid composition which flow into the chamber via the respective inlet flow paths, wherein at least a majority of the fluid composition flows through an inlet flow passage;

an actuator which displaces a deflector in the inlet flow passage, whereby the proportions of the fluid composition which flow into the chamber via the respective inlet flow paths are varied in response to the displacement of the deflector; and a fluid switch which, in response to a change in a property of the fluid composition, varies the proportions of the fluid composition which flow into the chamber via the respective inlet flow paths.

2. The system of claim 1, wherein the actuator comprises a swellable material.

3. The system of claim 1, wherein the actuator comprises a material which changes shape in response to contact with a selected fluid type.

4. The system of claim 1, wherein the actuator comprises a material which changes shape in response to a temperature change.

5. The system of claim 1, wherein the actuator comprises a piezoceramic material.

6. The system of claim 1, wherein the actuator comprises a material selected from the following group: piezoelectric, pyroelectric, electrostrictor, magnetostrictor, magnetic shape memory, permanent magnet, ferromagnetic, polymer hydrogel, and thermal shape memory.

7. The system of claim 1, wherein the actuator comprises an electromagnetic actuator.

8. The system of claim 1, further comprising a controller which controls operation of the actuator, and wherein the controller responds to a signal transmitted from a remote location.

9. The system of claim 8, wherein the signal comprises an electrical signal.

10. The system of claim 8, wherein the signal comprises a magnetic signal.

11. The system of claim 8, wherein the signal comprises a type selected from the following group: thermal, ion concentration, and fluid type.

12. The system of claim 1, wherein the fluid composition flows through the flow chamber in the well.

13. The system of claim 1, wherein the property comprises at least one of the following group: velocity, viscosity, density, and ratio of desired fluid to undesired fluid.

14. The system of claim 1, wherein deflection of the fluid composition by the actuator transmits a signal to a remote location.

15. The system of claim 14, wherein the signal comprises pressure variations.

16. The system of claim 14, wherein the signal comprises flow rate variations.

17. A method of variably controlling flow resistance in a well, the method comprising:

changing an orientation of a deflector in an inlet flow passage through which at least a majority of a fluid composition flows, thereby influencing the fluid composition to flow toward one of multiple inlet flow paths of a flow chamber, the chamber having a flow resistance which varies depending on proportions of the fluid composition which flow into the chamber via the respective inlet flow paths, wherein the fluid composition flows through the flow chamber in the well.

18. The method of claim 17, wherein changing the orientation of the deflector further comprises transmitting a signal to a remote location.

19. The method of claim 18, wherein transmitting the signal further comprises a controller selectively operating an actuator which displaces the deflector in the inlet flow passage.

20. The method of claim 18, wherein the signal comprises pressure variations.

21. The method of claim 18, wherein the signal comprises flow rate variations.

22. The method of claim 17, wherein changing the orientation of the deflector further comprises operating an actuator which comprises a swellable material.

23. The method of claim 17, wherein changing the orientation of the deflector further comprises operating an actuator which comprises a material which changes shape in response to contact with a selected fluid type.

24. The method of claim 17, wherein changing the orientation of the deflector further comprises operating an actuator which comprises a material which changes shape in response to a temperature change.

25. The method of claim 17, wherein changing the orientation of the deflector further comprises operating an actuator which comprises a piezoceramic material.

26. The method of claim 17, wherein changing the orientation of the deflector further comprises operating an actuator which comprises a material selected from the following group: piezoelectric, pyroelectric, electrostrictor, magnetostrictor, magnetic shape memory, permanent magnet, ferromagnetic, polymer hydrogel, and thermal shape memory.

27. The method of claim 17, wherein changing the orientation of the deflector further comprises operating an electromagnetic actuator.

28. The method of claim 17, wherein changing the orientation of the deflector further comprises operating an actuator in response to a signal transmitted from a remote location.

29. The method of claim 28, wherein the signal comprises an electrical signal.

30. The method of claim 28, wherein the signal comprises a magnetic signal.

31. The method of claim 28, wherein the signal comprises a type selected from the following group: thermal, ion concentration, and fluid type.

32. The method of claim 17, wherein a fluid switch, in response to a change in a property of the fluid composition, varies the proportions of the fluid composition which flow into the chamber via the respective inlet flow paths.

33. The method of claim 32, wherein the property comprises at least one of the following group: velocity, viscosity, density, and ratio of desired fluid to undesired fluid.

34. A variable flow resistance system for use with a subterranean well, the system comprising:

a flow chamber through which a fluid composition flows, the chamber having at least first and second inlet flow paths, and a flow resistance which varies depending on proportions of the fluid composition which flow into the chamber via the respective first and second inlet flow paths;

an actuator which deflects the fluid composition toward the first inlet flow path, wherein the actuator displaces a deflector in an inlet flow passage through which at least a majority of the fluid composition flows; and a controller which controls operation of the actuator, wherein the controller responds to a signal transmitted from a remote location.

35. The system of claim 34, wherein the actuator comprises a piezoceramic material.

36. The system of claim 34, wherein the actuator comprises a material selected from the following group: piezoelectric, pyroelectric, electrostrictor, magnetostrictor, magnetic shape memory, permanent magnet, ferromagnetic, polymer hydrogel, and thermal shape memory.

37. The system of claim 34, wherein the actuator comprises an electromagnetic actuator.

38. The system of claim 34, wherein the signal comprises an electrical signal.

39. The system of claim 34, wherein the signal comprises a magnetic signal.

40. The system of claim 34, wherein the signal comprises a type selected from the following group: thermal, ion concentration, and fluid type.

41. The system of claim 34, wherein the fluid composition flows through the flow chamber in the well.

42. The system of claim 34, further comprising a fluid switch which, in response to a change in a property of the fluid composition, varies the proportions of the fluid composition which flow into the chamber via the respective first and second inlet flow paths.

43. The system of claim 42, wherein the property comprises at least one of the following group: velocity, viscosity, density, and ratio of desired fluid to undesired fluid.

* * * * *